US010738546B2

(12) United States Patent
Rutledge

(10) Patent No.: US 10,738,546 B2
(45) Date of Patent: Aug. 11, 2020

(54) MULTI-PIECE ROD GUIDE FOR WELLS

(71) Applicant: Finalrod IP, LLC, Big Spring, TX (US)

(72) Inventor: Russell P. Rutledge, Big Spring, TX (US)

(73) Assignee: Finalrod IP, LLC, Big Spring, TX (US)

( * ) Notice: Subject to any disclaimer, the term of this patent is extended or adjusted under 35 U.S.C. 154(b) by 0 days.

(21) Appl. No.: 16/725,514

(22) Filed: Dec. 23, 2019

(65) Prior Publication Data

US 2020/0131869 A1 Apr. 30, 2020

Related U.S. Application Data

(63) Continuation of application No. 15/955,496, filed on Apr. 17, 2018, now abandoned.

(51) Int. Cl.

| | |
|---|---|
| ***E21B 19/24*** | (2006.01) |
| ***E21B 17/042*** | (2006.01) |
| ***E21B 17/10*** | (2006.01) |

(52) U.S. Cl.

CPC ..... *E21B 19/24* (2013.01); *E21B 17/042* (2013.01); *E21B 17/1007* (2013.01); *E21B 17/1071* (2013.01)

(58) Field of Classification Search

CPC ..... E21B 19/24; E21B 17/1071; E21B 37/02

See application file for complete search history.

(56) References Cited

U.S. PATENT DOCUMENTS

| | | | |
|---|---|---|---|
| 4,995,459 | A | 2/1991 | Mabry |
| 2016/0160579 | A1 | 6/2016 | McWatters |
| 2018/0112472 | A1 | 4/2018 | Gaskins |

*Primary Examiner* — Kristyn A Hall

(74) *Attorney, Agent, or Firm* — Matthews, Lawson, McCutcheon & Joseph, PLLC

(57) ABSTRACT

A guide for sucker rods comprises a cylindrical shape including an orifice for the sucker rod and four protrusions extending outwardly therefrom. The guide utilizes a symmetrical two-piece design wherein each piece comprises a semi-cylindrical shape, with one full protrusion extending the length of the guide and two half protrusions extending half the length of the guide and also beyond the semi-cylindrical profile. These two pieces are attached to each other by means of an interference fit between two pairs of interlock surfaces, one pair of which is located on the inner surface of the portion of the half-protrusions extending beyond the semi-cylindrical profile, and the other pair of which is located on the outer surface of the guide on the opposite side from the two half protrusions. Epoxy is injected into grooves along the internal surface of the cylindrical shape by means of ports extending through the rod guide.

10 Claims, 4 Drawing Sheets

B
24b
50
22
C
C
50
26b 50
18
32a
22
24b
A
A
34b
32b 28
17
26b
22

16
20
26a
28
24a 26b
18
17
24b
28

MULTI-PIECE ROD GUIDE FOR WELLS

REFERENCE TO RELATED APPLICATIONS

The present application is a continuation application of, and claims the benefit of and priority to, U.S. patent application Ser. No. 15/955,496, filed Apr. 17, 2018, having the title of "Multi-Piece Rod Guide For Wells," which is incorporated in its entirety herein.

FIELD

Embodiments usable within the scope of the present disclosure relate, generally, to an interference fit guide for sucker rods utilizing a two-piece design which allows the guide to be molded to the rod.

BACKGROUND

When production from a hydrocarbon well attainable through natural means (e.g., pressure within the wellbore) is no longer sufficient for the well to remain economically viable, numerous types of secondary recovery methods exist to increase the productivity of the well. One such method includes use of a downhole pump that is inserted into the wellbore, then actuated to draw hydrocarbons and/or other fluids toward the surface. Conventionally, downhole pumps are actuated by physically manipulating values and/or other operable parts from the surface, through movement of a pump jack or similar powered device connected to the downhole pump using a long string of joined connectors, termed "sucker rods."

When in use, these sucker rods are used in conjunction with sucker rod guides to prevent contact between sucker rods and production tubing. Depending on how straight or how vertical the individual wellbore is, these guides may be spaced on the rod depending on the engineering recommendations. Commonly, these rod guides are made using composite materials and thermoplastics including, e.g., polyphthalamide nylon, polyphenylene sulfide, and polyethylene.

The standard method of fitting a rod guide to a sucker rod involves direct-injection molding of the guide onto the rod body. This works reasonably well for instances where the sucker rod is steel, due to surface irregularities allowing the guide to hold in place. However, when the sucker rod is made of fiberglass, the smooth surface may allow the guide to slip when the sucker rod is under load. As a result, fiberglass sucker rods require an additional procedure in which the rod is sanded down at each guide location and a bead of epoxy is applied to the rod and allowed to harden into a "key" prior to the molding process to prevent slippage.

However, this process has drawbacks. Since the retention of the guide in place is directly related to the manual application of the epoxy, inconsistency in application can lead to wide variability in retention loading. In addition, the high heat (600° F.) of the direct-injection molding process may stress the fiberglass and cause damage. Finally, even a slight misalignment of the rod with the mold can subject the rod to clamping forces which damage it and require extensive inspection.

A need exists for a rod guide which can be used with both steel and fiberglass rods with reliability and consistency between applications.

Embodiments of the apparatus described herein meet this and other needs.

BRIEF DESCRIPTION OF THE DRAWINGS

In the detailed description of the embodiments, presented below, reference is made to the accompanying drawings.

One or more embodiments are described below with reference to the listed Figures.

DETAILED DESCRIPTION OF THE EMBODIMENTS

Before describing selected embodiments of the present disclosure in detail, it is to be understood that the present invention is not limited to the particular embodiments described herein. The disclosure and description herein is illustrative and explanatory of one or more presently preferred embodiments and variations thereof, and it will be appreciated by those skilled in the art that various changes in the design, organization, order of operation, means of operation, equipment structures and location, methodology, and use of mechanical equivalents may be made without departing from the spirit of the invention.

As well, it should be understood the drawings are intended to illustrate and plainly disclose presently preferred embodiments to one of skill in the art, but are not intended to be manufacturing level drawings or renditions of final products and may include simplified conceptual views as desired for easier and quicker understanding or explanation. As well, the relative size and arrangement of the components may differ from that shown and still operate within the spirit of the invention.

Moreover, it will be understood that various directions such as "upper," "lower," "bottom," "top," "left," "right," and so forth are made only with respect to explanation in conjunction with the drawings, and that the components may be oriented differently, for instance, during transportation and manufacturing as well as operation. Because many varying and different embodiments may be made within the scope of the concept(s) herein taught, and because many modifications may be made in the embodiments described herein, it is to be understood that the details herein are to be interpreted as illustrative and non-limiting.

The present invention relates, generally, to a rod guide which is molded separately from the sucker rod as a two-piece configuration, thereby preventing exposure of the sucker rod to the stressful high temperatures of the molding operation. The two pieces of the guide interlock in a wedge engagement that tightens onto the sucker rod using an interference fit, also known as a friction fit or force fit, under the application of axial force.

In an embodiment, the rod guide may feature internal pocket(s) molded to the guide to hold an epoxy adhesive which is applied to the guide during the interference fit. Unlike the prior art rod guides, this configuration relies on both the epoxy adhesive and the interference fit to provide load-bearing strength to the sucker rod against dislocation loads (i.e., loads tending to push the rod guide up or down along the sucker rod).

Figure 1A:
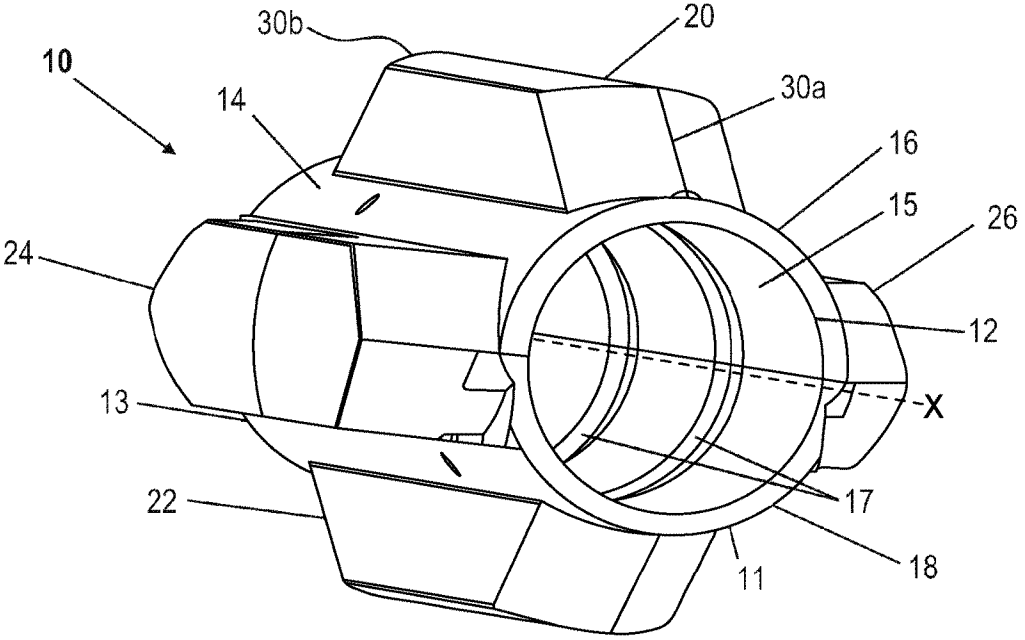
FIGS. 1A-1C show a perspective drawing of the invention in both assembled form (FIG. 1A) and disassembled form (FIGS. 1B-1C).
Figure 1C:
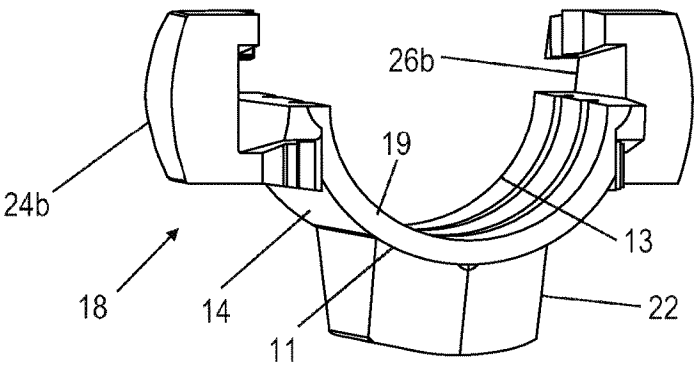
Figure 1B:
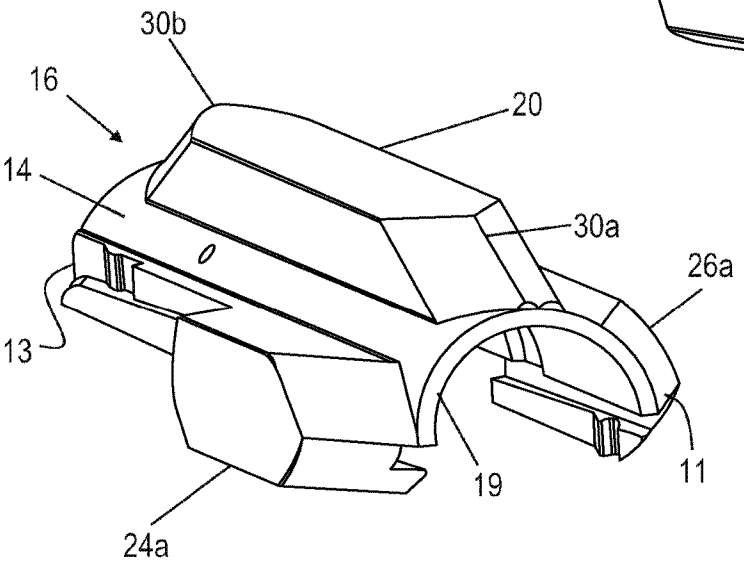

Referring now to FIGS. 1A-1C, an overall view of an embodiment of the rod guide 10 is shown in FIG. 1A, wherein the rod guide 10 is made up of two halves 16 and 18. FIG. 1B depicts, for clarity, the first half 16 by itself, while FIG. 1C depicts, for clarity, the second half 18 by itself.

Referring specifically to FIG. 1A, the assembled rod guide 10 comprises a generally cylindrical shape with an orifice 12 which equidistantly surrounds the longitudinal axis X of the rod guide 10 as well as an outer surface 14 and four protrusions 20, 22, 24, 26 equidistantly spaced around the outer surface 14 about the longitudinal axis X and extending from the first end 11 to the second end 13. As shown, protrusions 20 and 22 are solid pieces which are located entirely on the first half 16 and the second half 18, respectively. By contrast, protrusions 24 and 26 are formed from two bisected halves joining approximately halfway down the length of rod guide 10. Inner surface 15 comprises grooves 17 which extend circumferentially around the longitudinal axis X. While the pictured embodiment comprises two continuous, radial grooves 17, the guide may be manufactured with one or any number of grooves, with longitudinal or diagonal grooves, or with grooves that do not extend fully around the sucker rod, all without departing from the scope of the disclosure.

Referring specifically now to FIGS. 1B and 1C, each half 16, 18 comprises a semi-cylindrical profile 19, as well as a full protrusion 20, 22 (respectively) and two half protrusions 24*a*/24*b*, and 26*a*/26*b* (respectively) extending from outer surface 14. Full protrusions 20, 24 extend between first end 11 and second end 13 along substantially the full length of the halves 16, 18 (respectively), while half protrusions 24*a*/24*b* and 26*a*/26*b* terminate substantially halfway along the length of the halves 16, 18 (respectively). Additionally, half protrusions 24*a*/24*b* and 26*a*/26*b* extend circumferentially beyond the semi-cylindrical profile 19, forming an interlock profile (which will be described in detail later). Once the first half 16 and second half 18 of the rod guide are assembled, half protrusions 24*a* and 24*b* form protrusion 24, and half protrusions 26*a* and 26*b* form protrusion 26.

In addition, each protrusion 20, 22, 24, 26 terminates along the longitudinal axis X in two tapered edges, one on each end of the rod guide 10. For brevity, only the tapered edges 30*a*, 30*b* corresponding to protrusion 20 are labeled in FIGS. 1A-1C; protrusions 22, 24, and 26 feature similar termination profiles. These tapered edges 30*a*, 30*b* represent an alternative to the available guides which utilize thermoplastic molding, as these guides often utilize blunt leading edges which increase fluid turbulence when inserted into the fluid and therefore increase drag. The pointed or bow shape of the tapered edges of protrusions 20, 22, 24, 26 results in less drag in operation and therefore less possibility of hanging up the rod.

Figure 2:
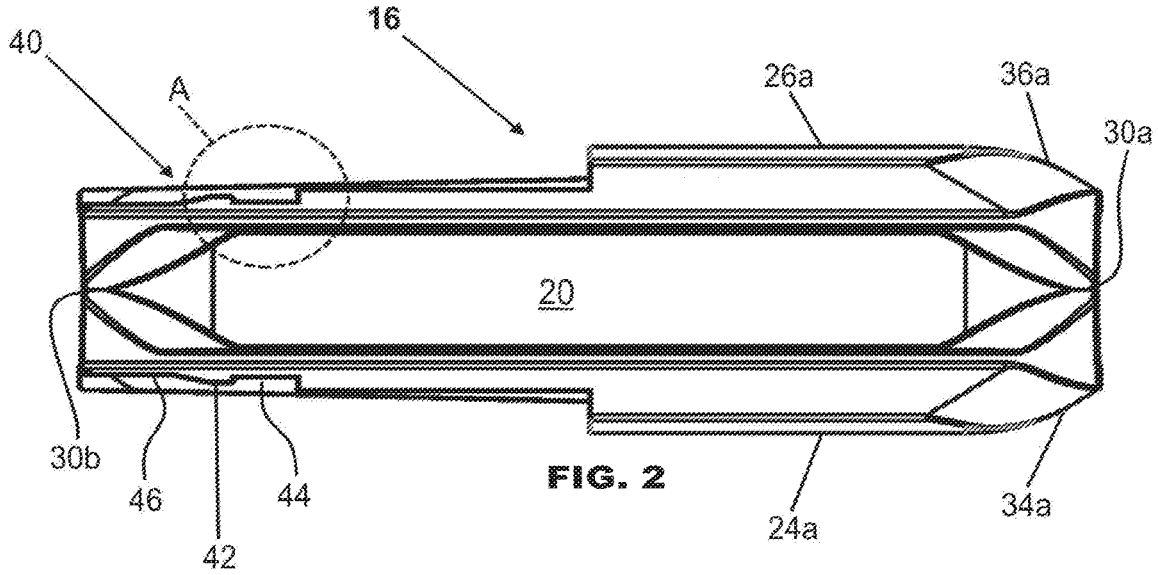
FIG. 2 depicts an overhead view of one piece of the invention in disassembled form, and with area A magnified as FIG. 2A.

Turning now to FIG. 2, guide half 16 is depicted in greater detail in an overhead view. Full protrusion 20 and half protrusions 24*a* and 26*a* are shown, terminating in tapered edges 30*a*, 34*a*, and 36*a* respectively, with full protrusion 20 also terminating in tapered edge 30*b*. Additionally, the overhead view shows the inner interlock profiles 40, one of which is magnified in greater detail in FIG. 2A. The inner interlock profiles 40 of the guide half 16 are located on the opposing halves of the outer surface 14 from the half protrusions 24*a* and 26*a*. Inner interlock profiles 40 each comprise a wedge 42 and two recesses 44, 46 located on either side of wedge 42 along the longitudinal axis (not shown but identical to that depicted in FIGS. 1A-1C).

Figure 2A:
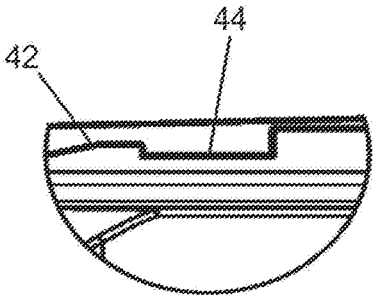
Figure 3A:
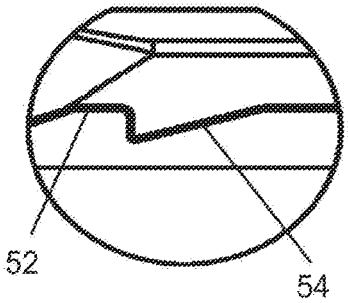
FIG. 3 depicts an underhead view of one piece of the invention in disassembled form, with area A magnified as FIG. 3A.
Figure 3:
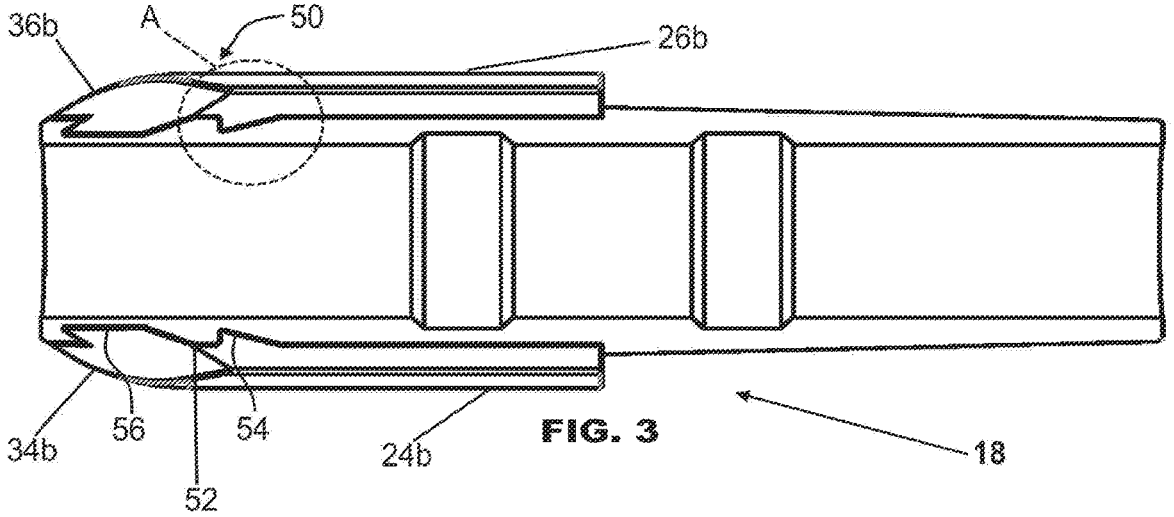

Turning now to FIG. 3, guide half 18 is depicted in overhead view in the same orientation as guide half 16 of FIGS. 2 and 2A. As previously stated, guide half 18 comprises two half protrusions 24*b* and 26*b* as well as a full protrusion 22 (on the underside and not visible in this view). Half protrusions 24*b* and 26*b* terminate in tapered edges 34*b* and 36*b*, respectively. The outer interlock profiles 50 of the guide half 18 are located on the inner surfaces of the half protrusions 24*b* and 26*b*, at the same location along the longitudinal axis as the inner interlock profiles 40. A magnified view of outer interlock 50 is shown in greater detail as FIG. 3A. Outer interlock profiles 50 comprise a recess 52, corresponding with the wedge 42 of the inner interlock profiles 40; as well as two wedges 54, 56 corresponding with the recesses 44, 46 of the inner interlock profiles 40.

During assembly, the inner interlock profiles 40 on either side of guide half 16 form an interference fit with the outer interlock profiles 50 of guide half 18. In addition, guide half 16 also comprises outer interlock profiles (not shown) and guide half 18 also comprises inner interlock profiles (not shown) at the same positions; these are not visible in the overhead and underhead views, they are located in the same positions and function identically. Thus, each guide half 16, 18 comprises both a pair of inner interlock profiles located on the outer surface 14, as well as a pair of outer interlock profiles which are located on the half protrusions 24*a*/24*b*, 26*a*/26*b*.

Figures 4, 4A, 4B, 4C, 5, 6:
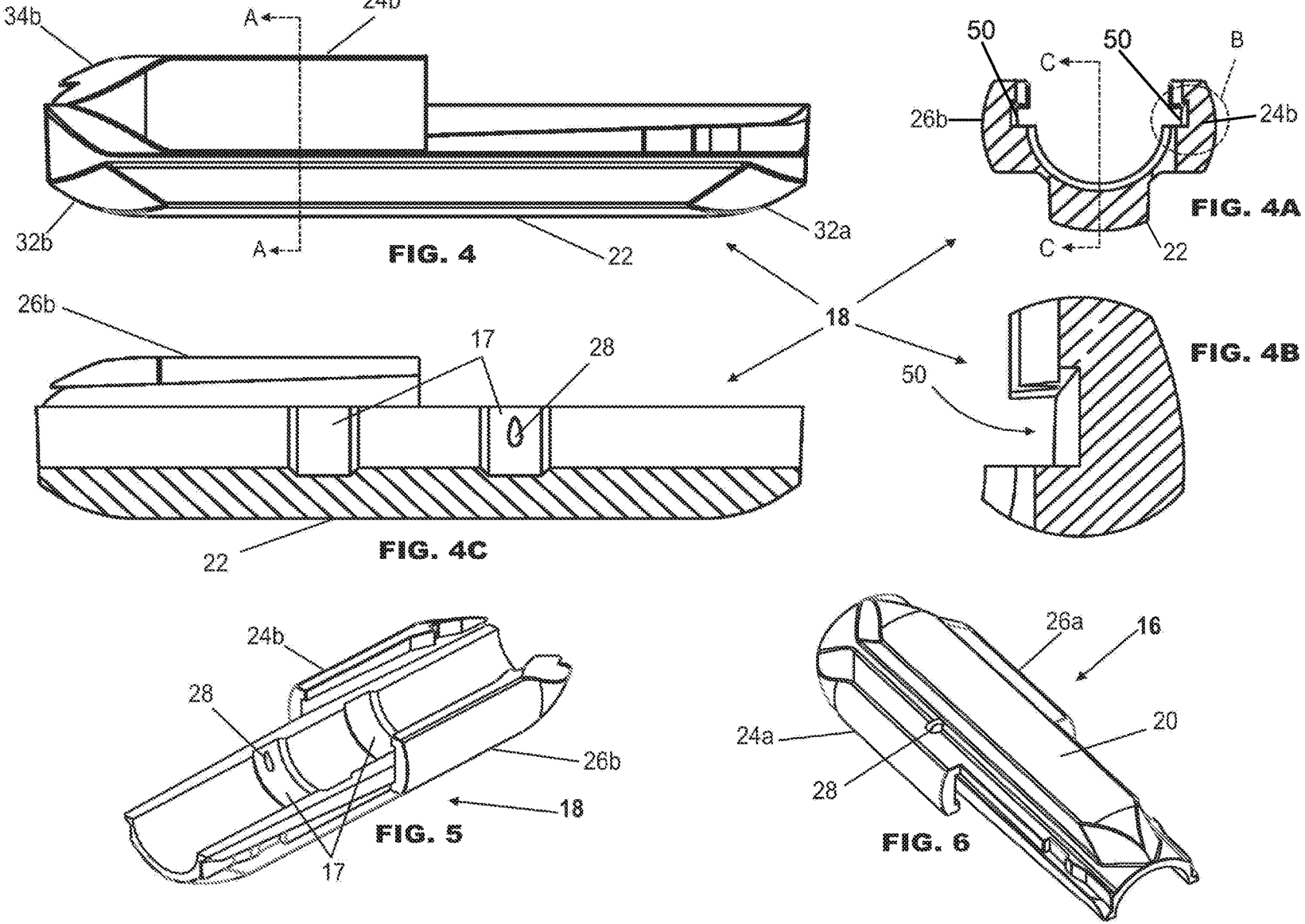
FIG. 4 depicts a side view of one piece of the invention in disassembled form, with a cross-section along line A-A shown as FIG. 4A, with area B magnified as FIG. 4B, and a cross-section along line C-C shown as FIG. 4C FIGS. 5-6 show perspective views of the invention in disassembled form.

Turning now to FIG. 4, a guide half 18 is shown in side view comprising a full protrusion 22 terminating in tapered edges 32*a* and 32*b*, as well as a half protrusion 24*b* terminating in tapered edge 34*b*. FIG. 4A shows a cross section of guide half 18 along section line A-A, in which the full protrusion 22 and half protrusions 24*b*, 26*b* are shown, as well as the pair of interlock profiles 50 located on the inner surfaces of half protrusions 24*b*, 26*b*, a magnified view of which is shown as FIG. 4B. FIG. 4C shows another cross section of guide half 18 along section line C-C, this time with half protrusion 26*b* visible behind half protrusion 24*b* (not visible in this cross-section, shown in FIG. 4). In addition, grooves 17 are visible, as well as port 28.

Turning now to FIGS. 5-6, guide halves 16, 18 are shown in perspective view, with half protrusions 24*a*/24*b* and 26*a*/26*b*, as well as full protrusion 20. Additionally, ports 28 are shown in guide halves 16 and 18, respectively, as well as grooves 17. During assembly, the grooves 17 are filled with epoxy or other adhesive which can be injected into the space between the grooves 17 and the sucker rod through ports 28. Alternatively, the adhesive may be placed into the grooves 17 prior to the installation of the rod, with the ports 28 allowing excess adhesive to escape and be manually wiped down subsequent to installation. When cured, the epoxy forms a bump or wedge within the groove 17 which additionally binds to the guide and the rod (and thus binds the guide to the rod).

Figure 7:
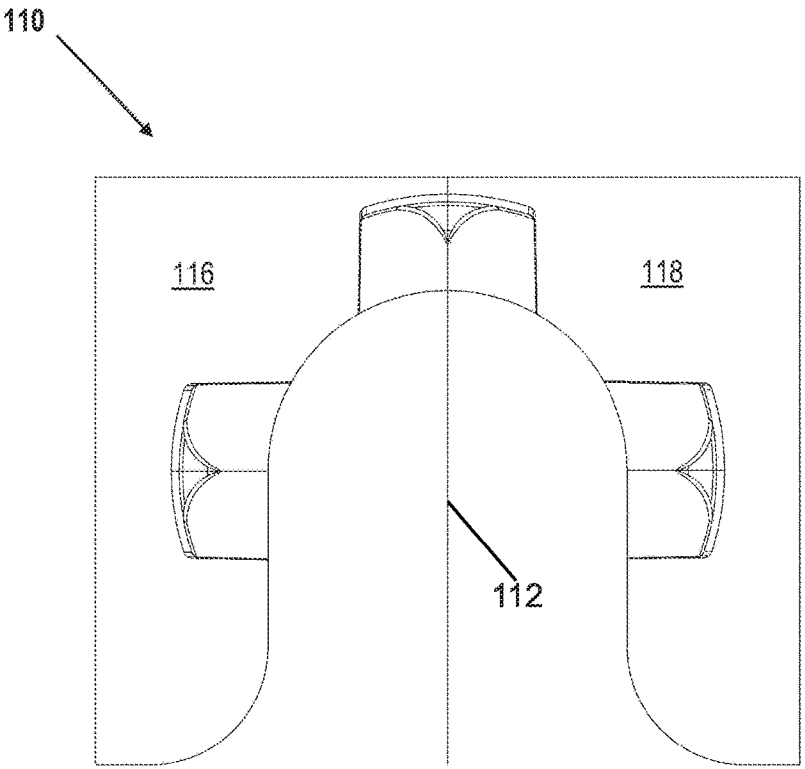
FIG. 7 depicts a negative mold for use in a method embodiment of manufacture for the present invention.

Turning now to FIG. 7, in a method embodiment, the guide halves 16, 18 (not shown in this figure) are constructed using an injection mold 110 which comprises two halves 116, 118 across a longitudinal axis 112. The two halves of the mold 110 each comprise a negative shape corresponding to the shape of the halves 16, 18 depicted in the earlier FIGS. In an embodiment, the guide halves may be formed from polyphthalamide thermoplastic. In an embodiment, this may comprise up to 33% glass reinforcement. It can be appreciated that any suitable material may be used provided it is sufficiently ductile to form the interference fit but sufficiently heat-resistant to withstand downhole temperatures.

Figure 8:
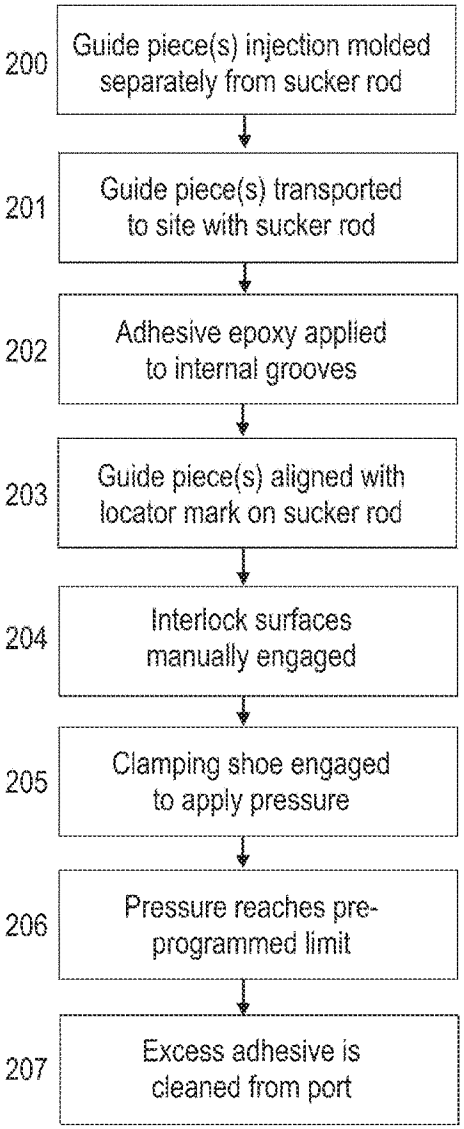
FIG. 8 is a flow chart depicted a method embodiment for using the present invention.

Turning now to FIG. 8, a method embodiment of use for the rod guide is illustrated as a flow chart. As a first step 200, the injection molding takes place in advance at a facility which may be separate from the facility where the rod guides are applied to rods, allowing for mass prefabrication of rod guides for common sucker rod dimensions to be accumulated and shipped 201 to an area with a suitable sucker rod, representing a logistic improvement over present methods in which the injection molding takes place on the rod itself. Since the method does not rely on any irregularities or interference with the rod itself, it is suitable for both fiberglass rods and steel rods.

In the next step 202, epoxy adhesive is applied to the internal guide surfaces as described in FIG. 6. Subsequently 203, the guide pieces are aligned with a locating mark on the sucker rod (this mark may correspond to any suitable feature of the rod guide). Installation takes place utilizing a specially designed hydraulic press wherein the press surfaces comprise steel shoes having the negative shape of the guide rod. The interlock surfaces are manually engaged 204 prior to the application of pressure to the rod. A clamp having specially manufactured guide shoes (again in the negative shape of the rod guide) locks the rod into place 205 to prevent slipping along the rod during installation, and the press forces the guide together without damaging the rod.

In a method embodiment, the ram force of the hydraulic press shoes is controlled 206 with a programmable pressure transducer which controls the compressing action such that the hydraulic press ceases applying pressure once a predetermined force has been achieved, after which the operator installing the rods may remove excess adhesive 207 and then repeat the procedure along the next guide position.

Although several preferred embodiments of the invention have been illustrated in the accompanying drawings and described in the foregoing specification, it will be understood by those of skill in the art that additional embodiments, modifications and alterations may be constructed from the invention principles disclosed herein, while still falling within the scope of the disclosed invention.

The invention claimed is:

1. A method of fitting a rod guide to a sucker rod, comprising:

molding a plurality of guide pieces having two semi-cylindrical profiles for forming a rod guide, wherein each semi-cylindrical profile comprises:

a first end, a second end, an outer surface, and an inner surface;

at least one internal groove along the inner surface;

a plurality of protrusions extending from the outer surface along a longitudinal axis of the semi-cylindrical profile, wherein each protrusion comprises a first end and a second end, and wherein the first end and the second end of each protrusion terminates in a pair of tapers forming a bow-shaped edge extending from a center of each protrusion to the outer surface for reducing fluid turbulence and increasing fluid flow;

a plurality of inner interlock profiles located on outer surfaces of a first half protrusion; and a plurality of outer interlock profiles located on inner surfaces of a second half protrusion, wherein the first half protrusion is positioned opposite the second half protrusion;

transporting the plurality of guide pieces to an installation location having a sucker rod;

applying an adhesive to said at least one internal groove along said inner surface of each semi-cylindrical profile of the plurality of guide pieces;

aligning the plurality of guide pieces with each other along the sucker rod;

engaging the plurality of inner interlock profiles with the plurality of outer interlock profiles, wherein each inner interlock profile comprises a central wedge and two recesses located on either side of the central wedge along the longitudinal axis, and wherein each outer interlock profile comprises a corresponding central recess and two corresponding wedges located on either side of the corresponding central recess along the longitudinal axis; and applying a predetermined force to the plurality of guide pieces such that the outer surfaces of the plurality of inner interlock profiles and the inner surfaces of the plurality of outer interlock profiles adjoin and deform each other to create an interference fit rod guide along the sucker rod to prevent a misaligning, a dislocating, a slipping, a dropping, or combinations thereof of the sucker rods.

2. The method of claim 1, wherein the step of aligning the plurality of guide pieces with each other along the sucker rod comprises making a locating mark on the sucker rod and aligning the plurality of guide pieces therewith.

3. The method of claim 1, wherein the step of molding a plurality of guide pieces comprises injecting a thermoplastic polymer into a mold, wherein the mold comprises a negative shape equivalent to the plurality of guide pieces.

4. The method of claim 3, wherein the thermoplastic polymer comprises a polyphthalamide.

5. The method of claim 3, wherein the thermoplastic polymer comprises up to 33% glass reinforcement.

6. The method of claim 1, wherein the outer surface of each semi-cylindrical profile further comprises a plurality of ports, wherein the plurality of ports define a path from the outer surface to the at least one internal groove.

7. The method of claim 1, wherein the step of applying the adhesive to said at least one internal groove comprises filling said at least one internal groove with an epoxy.

8. The method of claim 7, further comprising the step of removing excess said epoxy from the plurality of ports in communication with the at least one internal groove.

9. The method of claim 1, wherein the step of applying the pre-determined force to the plurality of guide pieces comprises a hydraulic press having steel shoes, wherein the steel shoes comprise a negative shape equivalent to the plurality of guide pieces.

10. The method of claim 1, further comprising locking the rod guide along the sucker rod during installation using a clamp comprising guide shoes, wherein the guide shoes comprise a negative shape equivalent to the plurality of guide pieces, and wherein the locking of the rod guide prevents slipping of the rod guide along the sucker rod.

* * * * *